United States Patent [19]

Hulsing

[11] 3,982,693

[45] Sept. 28, 1976

[54] ORIFICE PLUNGER VALVE FUEL INJECTOR

[75] Inventor: Kenneth L. Hulsing, Plymouth, Mich.

[73] Assignee: General Motors Corporation, Detroit, Mich.

[22] Filed: Jan. 16, 1976

[21] Appl. No.: 649,790

[52] U.S. Cl. ..... 239/88; 239/533; 239/584

[51] Int. Cl.[2] ..... B05B 1/32; F02M 47/00

[58] Field of Search ..... 239/88–91, 239/533, 584, 96

[56] References Cited

UNITED STATES PATENTS

| | | | |
|---|---|---|---|
| 2,088,007 | 7/1937 | Zumbusch | 239/88 X |
| 2,521,224 | 9/1950 | Kammer | 239/88 |
| 2,762,654 | 9/1956 | Purchas et al. | 239/533 X |
| 2,898,051 | 8/1959 | Teichert | 239/88 X |
| 2,951,643 | 9/1960 | Engel | 239/90 |
| 3,006,556 | 10/1961 | Shade et al. | 239/88 |
| 3,075,707 | 1/1963 | Rademaker | 239/533 X |
| 3,257,078 | 6/1966 | Mekkes | 239/533 X |

FOREIGN PATENTS OR APPLICATIONS

| | | | |
|---|---|---|---|
| 925,343 | 3/1947 | France | 239/533 |

*Primary Examiner*—Robert S. Ward, Jr.
*Attorney, Agent, or Firm*—Arthur N. Krein

[57] ABSTRACT

An orifice plunger valve fuel injector is provided with a nozzle body having a bore extending from one end thereof, a plunger valve being slidably mounted and closely fitted within the bore of the nozzle body, the end of the plunger valve adjacent said one end of said nozzle body being provided with radially extending spray tip holes therein which are supplied with pressurized fuel through an axial passage in the plunger valve in communication at one end with the spray tip holes and at its other end, intermediate the ends of the plunger valve, with at least one radial passage in communication with an inlet fuel passage means in the nozzle body supplied with fuel under pressure through a one-way valve from a source of fuel under pressure, a retractor spring being positioned in the nozzle body and operatively connected with the plunger valve to normally bias the plunger valve into a retracted position within the bore of the nozzle body whereby the spray tip holes are closed off by the bore wall of the nozzle body, when the pressure of fuel in said fuel passage is less than the pressure required acting on the differential area of the plunger valve to effect its axial displacement in the bore of the nozzle body, against the force of the retractor spring, to a position where the spray tip holes are uncovered to effect fuel injection. The spray holes will be uncovered only sufficiently to maintain the predetermined fuel injection pressure at the orifices formed by the spray tip holes in the plunger valve and the lower end of the nozzle body.

7 Claims, 3 Drawing Figures

ORIFICE PLUNGER VALVE FUEL INJECTOR

This invention relates to a device for injecting fuel into the cylinders of an internal combustion engine and, in particular, to a fuel injector or fuel injection nozzle for such a device.

Fuel injectors or fuel injection nozzles whether used as part of a unit injector or as part of a pump and nozzle system are normally of the needle valve controlled type that includes a nozzle body having a spray tip at one end thereof with spray orifices therein in communication with an axial passage in the nozzle body supplied with fuel under pressure, flow of fuel through the passage to the spray orifices being controlled by a needle valve having a seat at one end thereof adapted to cooperate with a seat in the nozzle body upstream of the spray orifices, the needle valve being normally biased to a closed position by a closing spring. In this type fuel injector, there is normally at least some so-called "sac volume" when the needle valve is closed between its seat and the discharge end of the spray orifices, which sac volume contains raw fuel after the injection cycle has been terminated that can then dribble into the cylinder of the engine with which the fuel injector is associated.

It is also well known in the art of fuel injection that the needle valve on both opening and closing will have an area less than that of the spray orifices. This causes the very first fuel and the very last fuel injected to be poorly atomized and causes dribble. And further, in those nozzles where the needle seat is formed over the spray orifices for the purpose of preventing the "sac volume" from escaping, there is still raw fuel in the spray orifices which cannot be prevented from entering the combustion chamber of the associated engine. This invention eliminates that possibility.

In addition, in these prior art needle valve type injectors or nozzles, the force of the closing spring must be sufficient to effect seating of the needle valve against cylinder pressure which acts to hold the needle valve open.

It is therefore a primary object of this invention to provide an improved fuel injector or injection nozzle of the type wherein the fuel delivery is controlled by a piston or plunger type valve operable in response to a predetermined fuel injection pressure, the discharge spray orifices of the device being incorporated in the piston or plunger valve.

Another object of this invention is to provide an improved fuel injector or injection nozzle of the type wherein the fuel delivery is controlled by a piston or plunger type valve with the fuel injection pressure applied only to the differential area of the valve of the injector or injection nozzle.

A further object of this invention is to provide an improved fuel injector or injection nozzle that is of simple, but rugged construction, that is easily manufactured and can be easily serviced.

These and other objects of the invention are obtained by a fuel injector having a nozzle body with a stepped bore therein defining an annular valve sleeve wall extending from one end of the nozzle body and a spring chamber closed at one end within the opposite end of the nozzle body, a plunger valve having a fuel passage therein which extends to adjacent one end thereof that is in communication with radial spray orifices extending through the wall of the plunger valve adjacent this one end, the plunger valve being reciprocally mounted in the stepped bore of the nozzle body for movement between a retracted position in which the spray orifices are closed off by the valve sleeve wall and an extended position in which the end of the valve body having the spray orifices therein projects axially outward of the valve sleeve wall, a spring being positioned in the spring chamber and connected to the plunger valve to normally bias the plunger valve to the retracted position and, a valve controlled fuel passage means in the nozzle body adapted to be connected at one end to a source of fuel at high pressure and at its opposite end, the passage means is in fluid flow communication with the fuel passage in the plunger valve.

For a better understanding of the invention, as well as other objects and further features thereof, reference is had to the following detailed description of the invention to be read in connection with the accompanying drawings, wherein.

Figure 1:
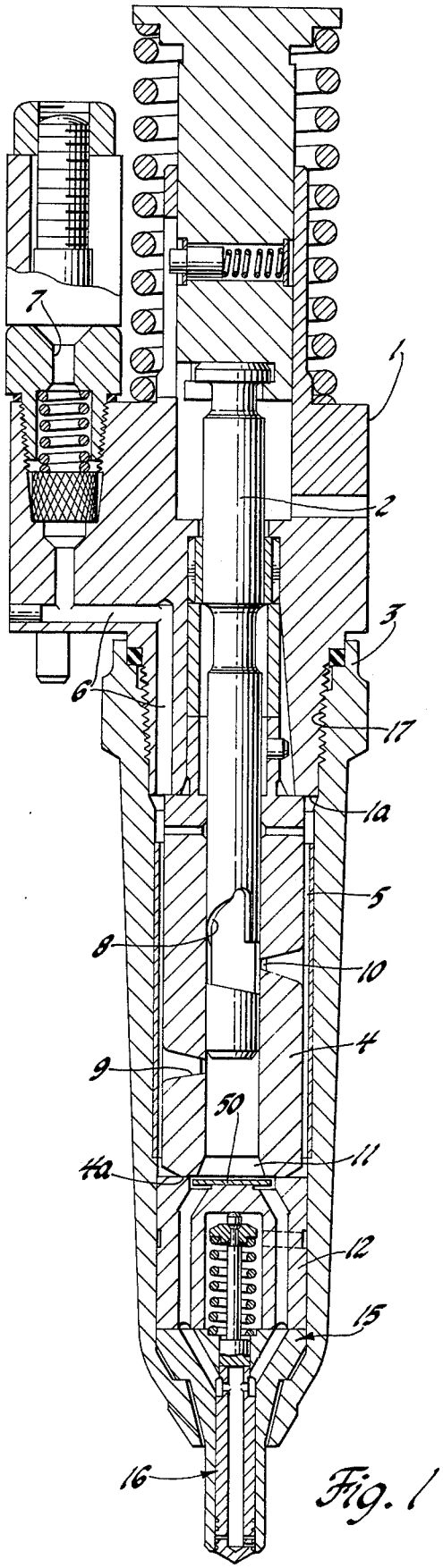
FIG. 1 is a longitudinal sectional view through a unit type fuel pump-injector having a fuel injector in accordance with a preferred embodiment of the invention incorporated therein.

Referring now in detail to the drawings and, in particular to FIG. 1, there is shown a unit fuel pump-injector, the upper portion of which is conventional and comprises a housing 1 in which a pump plunger 2 is reciprocally mounted. Forming an extension of and threaded to the lower end of the housing 1 is a nut 3 within which is supported a bushing 4, forming the pump cylinder for the plunger 2. An annular space or fuel chamber 5 surrounding the bushing 4 within the nut 3 is supplied with fuel at a relatively low supply pressure via the passage means 6 in the housing 1 from an external fuel inlet connection 7 in a well-known manner, the fuel chamber 5 also being in communication with an outlet connection (not shown) also in a well-known manner. The plunger 2 has the usual central passage (not shown) at the lower end thereof and the usual external metering groove helix 8 adjacent to its lower end by which opening and closing of the lower port 9 and upper port 10 in the bushing are controlled during each downward stroke of the plunger 2 to deliver a predetermined volume of fuel through the lower open end 11 of the bushing for injection into the cylinder of an engine (not shown) via the fuel injector or fuel injector nozzle of the invention, to be described, at the bottom of this unit. Other details of the upper or pump part of the unit are not important to the present invention, and are common to conventional constructions of the type, for example, as shown and described in such prior patents as U.S. Pat. No. 2,951,643 entitled "Fuel Injector with Pilot Injection" issued Sept. 6, 1960 to Royce G. Engle, Jr. and U.S. Pat. No. 2,898,051 entitled "Fluid Injection Device" issued Aug. 4, 1959 to Conrad A. Teichert, and hence will not require further description herein.

The nut 3 has an opening **3*a* at its lower end through which extends the lower end of a fuel injector or fuel injection nozzle, hereinafter referred to as a nozzle, in accordance with the invention. The nozzle includes a nozzle body, which for ease in manufacturing and assembly is formed in two parts and includes a spring retainer or cage 12 with a spring chamber 14 therein and a nozzle valve body 15, the lower end 15***a* thereof extending through the opening 3*a* and having a piston or plunger valve, generally designated 16, reciprocally mounted therein in a manner to be described. As shown, the nozzle valve body 15 is enlarged above its lower end 15*a* to provide a shoulder 15*b* which seats on a shoulder 3*b* provided by the through counterbore in the nut 3 and the upper enlarged end of the nozzle valve body abuts against the spring cage 12 which, in turn, abuts against the lower end face 4*a* of the bushing 4. The threaded connection 17 of the nut 3 to housing 1 holds the nozzle valve body 15, spring cage 12 and bushing 4 clamped in stacked end-to-end relation between the shoulder 3*b* of nut 3 and the bottom face 1*a* of the housing 1. The spring cage 12 has a predetermined radial clearance between its outer peripheral surface and the adjacent inner peripheral surface of the nut 3, whereby the spring chamber 14 can be vented in a manner and for a purpose to be described.

The nozzle valve body 15 is provided with a stepped bore therethrough providing, in sequence, an internal annular wall 20 extending a short distance from the upper end of the valve body, an internal wall 21, with an intervening radial shoulder 22 therebetween, and an internal annular sleeve or wall 23 which is open to the engine combustion chamber of a cylinder (not shown), the internal diameter of wall 23 being greater than the internal diameter of wall 21 but less than the internal diameter of wall 20 in the construction illustrated.

The plunger valve, which is reciprocably mounted within the nozzle body, in the construction illustrated, is fabricated in two pieces that are suitably secured together as by an inertia or electron beam weld into a unitary structure and, in the preferred embodiment, includes a lower stem portion 30 which has a close sliding lapped fit with the bore portion of the valve body forming the internal annular wall 23, an intermediate stem portion 31 of a diameter to be slidably received by the wall 21 and a stepped reduced diameter upper stem portion 32 terminating at an enlarged head 33, the stem portion 32 and head 33 extending loosely into the spring chamber 14 of cage 12. Between the shoulder 22 at the upper end of the valve body 15 and the annular retainer ring 34 encircling the stem portion 32 in abutment against the underside of head 33 is a compression spring 35 which serves to urge the plunger valve 16 upward within the valve body to a retracted position, the position shown in FIGS. 1 and 2, at which the head 33 of the plunger valve abuts against a stop wall 36 defining the upper wall of the spring chamber 14 within the cage 12.

Extending longitudinally within the lower stem portions 30 and 31 of the plunger valve 16 is an internal fuel passage 41, the upper and lower ends of which are closed. As shown, the upper end of the fuel passage 41 is closed, beneath this closed end, the walls of the stem portion 31 defining this portion of the passage 41 are provided with one or more transverse inlet passages 42 whose outer ends terminate at an annular groove 43 formed on the outer periphery of the stem 31, next adjacent to the upper end of stem 30, whereby the passage 41 can be placed in communication with fuel at high injection pressure in a manner to be described. As shown, the lower end of the fuel passage 41 is also closed and above its closed end, the walls of the stem 30 portion defining this passage are provided, if desired, with one or more radial extending pilot spray orifices 44, only one being shown, and above the pilot spray orifice 44, if used, this wall is provided with a plurality of radial extending spray orifices 45, fuel being discharged through these orifices which serve as discharge outlets during the injection period, to be described, but discharge from these orifices is normally prevented by the closure thereof by the wall 23 of the valve body 15 when the plunger valve 16 is in its retracted position, as shown.

The lower end face 4*a* of the bushing 4 also serves as a closure seat for a circular check valve or disk 50. The check valve or disk 50 is disposed in a cavity 51 formed in the upper end of the cage 12, the size of this cavity extending laterally beyond the lateral extremities of the open end 11 of the pump cylinder in bushing 4 and serves to loosely guide the check valve or disk 50. A central protruberance 52 is provided at the bottom of the cavity 51 and serves to limit opening travel of the check valve or disk 50.

The cavity 51 also forms the upper end of a fuel passage means connecting the open end 11 of the pump cylinder with the fuel discharge outlets or spray orifices 44 and 45, this passage means including longitudinally extending passages 53 in the cage 12 that are connected at one of their ends with the cavity 51 and at their opposite ends with a connecting annular groove 54 provided in the lower end face of a cage 12, in the construction shown. This annular groove 54, in turn, is in communication with one end of connecting passages 55 in the upper end of the valve body 15, the opposite ends of these connecting passages 55 intersecting the stepped bore in the valve body 15 by extending through its wall 23 next adjacent to the wall 21 to place these passages in fluid communication with the annular groove 43 in the plunger valve 16.

From the above description of the passage means used to connect the discharge or spray orifices 44 and 45 of the plunger valve 16 to a source of high pressure fuel, such as the pump cylinder of the injector pump, it will be apparent that the large volume of the spring chamber 14 in the cage 12 is not in the high fuel pressure circuit of the injector thereby permitting better control of fuel injection. Any internal leakage of pressurized fuel to the spring chamber 14 is drained therefrom by means of a radial passage 60 extending from this spring chamber through the walls of the spring cage 12 to an annular groove 61 on the outer periphery of the cage 12, fuel then flowing from this annular groove through the previously described clearance space between the cage 12 and the nut 3 to the annular space or fuel chamber 5, as previously described, containing fuel at a relatively low supply pressure.

Figure 2:
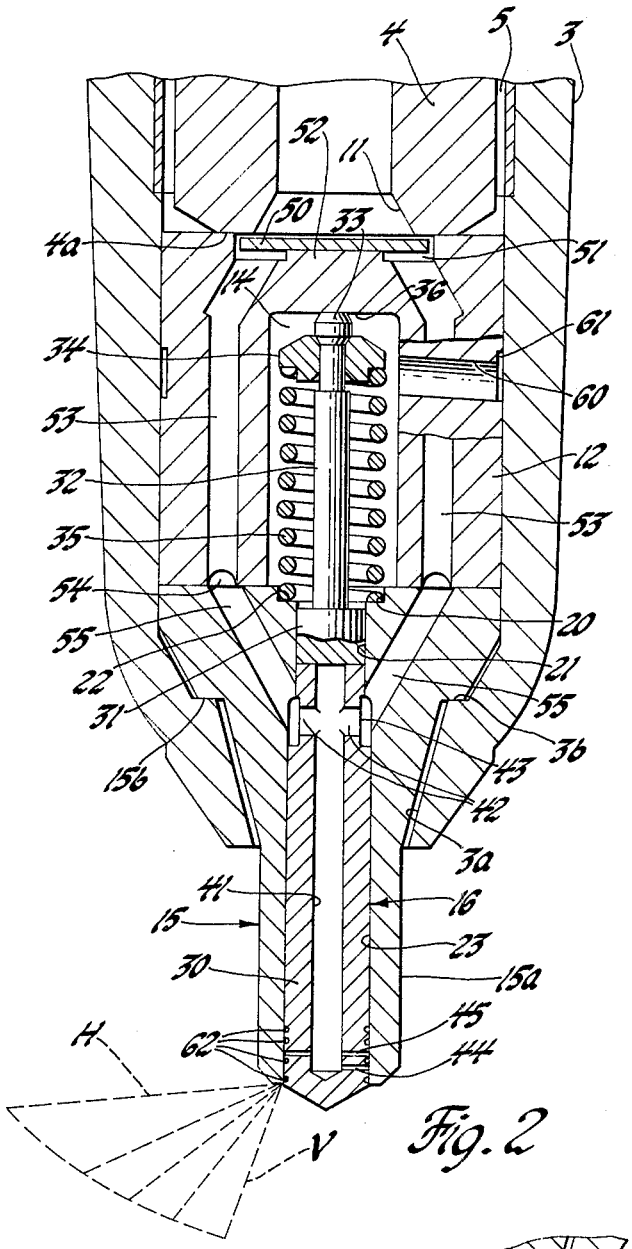
FIG. 2 is a fragmentary view of FIG. 1 but enlarged to show the details of the fuel injector; and, FIG. 3 is a fragmentary view, similar to FIG. 2, but showing an alternate embodiment of the plunger valve of the fuel injector.

In operation, beginning with the parts in their positions as shown in FIGS. 1 and 2 of the drawings, with the plunger 2 at the top of its stroke, fuel introduced through the inlet connection 7 enters the fuel chamber 5 and flows through the ports 9 and 10 into the pump cylinder below the plunger 2. As the plunger 2 starts down, fuel is displaced back into the supply chamber 5 through the lower port 9 and up through the central passage (not shown) in plunger 2 and through the upper port 10. When the lower port 9 has been covered by the plunger 2, bypass continues through the upper port 10 until it is covered by the plunger upper helix of helix groove 8 at which point the fuel in the pump cylinder of the bushing 4 is compressed to unseat the check valve 50. When this pressure reaches the preselected atomizing pressure determined by the spring 35 biased against the differential area of bore 21 and 23, the variable area orifice feature of the nozzle will start fuel atomization first in the pilot spray orifice if it is used and then in the main orifices 44. The degree to which the main orifices open will be a function of engine speed and quantity of fuel injected, as determined by position of helix 8 with relation to port 10.

As shown schematically by the broken lines in FIG. 2, the spray development from each spray orifice starts with a nearly vertical component V that sweeps up to a substantially horizontal component H from the start of uncovering of a spray orifice to the final full uncovering of the spray orifice as it moves beyond the lower edge of inner peripheral wall 23 of the nozzle body 15. However, it should be realized that this full sweep, just described, will not occur under all operating conditions. For instance, at 50% fuel input, the spray angle would not reach the horizontal position. It would, however, always start at the nearly vertical position. As the fuel pressure is dissipated during fuel injection, the spring 35 will again act to retract the plunger valve to the retracted position shown in the drawings, the spray orifices 45 and 44 being sequentially closed off in that order by the inner wall 23 during retraction of the plunger valve 16 therein.

Movement of the plunger valve from the retracted position to the extended position is effected by the high injection pressure of the fuel acting on the differential area of the plunger valve, which is an area corresponding to the difference in area of 23 and 21. The spring 35, of course, biases against the fuel pressure acting on the differential area. Accordingly, the load of spring 35 to control a selected, predetermined fuel injection pressure can be much lower than that used in conventional fuel injectors. In addition, it should also be realized that the plunger valve 16 will also be acted upon by the pressure in the cylinder (not shown) to assist it in moving from the extended position to its retracted position.

In the event the plunger valve 16 fails to retract from its extended position to its retracted position for any reason at the end of the injection cycle, a reverse flow of fuel and combustion gases from the cylinder of the engine via the spray orifices and the passages in the plunger valve 16 and the passage means in the valve body 15 and cage 12 to the cavity 51 and then into the pump cylinder is prevented by closing of the check valve or disk 50 against its seat 4*a* on the bushing 4.

As previously described, the lower stem portion 30 of the plunger valve 16 is in a lapped fit relative to the internal wall 23 of the nozzle body 15 to thereby suitably minimize the possibility of fluid flow in the clearance space between these elements in one direction and to prevent the flow of gases from the engine cylinder in the opposite direction. In order to provide a further seal between these elements, the lower end of the stem 30 of the plunger valve 15 is provided with a series of shallow annular seal grooves 62 adjacent to its free end, which grooves, during the operation of the subject fuel injector, will fill with carbon from the combustion products in the engine cylinder to thereby form a carbon seal in each of the grooves which will be in sliding sealing engagement with the lapped surface of wall 23 of the valve body 15.

By reason of the spray orifices 44 and 45 being closed off by the sleeve wall 23 of the nozzle body, except when sufficient fuel pressure exists to force the plunger valve to its extended position, the start and finish of the injection period for the subject fuel injector is much more "sharp" than is the case with previous constructions. Because of the way the spray pattern is developed, as previously described, during the opening movement of the plunger valve to effect injection, the hole sizes and shapes of these spray orifices are less critical than in conventional structure and, regardless of the size or shape of these spray orifices, no fuel is available for afterflow or drip at the end of an injection period since these spray orifices are fully retracted within and closed off by the sleeve wall 23 of the nozzle body when the plunger valve is in its retracted position. Also, as will be evident and as previously described, the positive closing of these spray orifices 44 and 45 after each injection period resulting from the withdrawal of the plunger valve stem 30 and its close fit in the sleeve wall 23 effectively eliminates any possibility of air or combustion gases being blown into the fuel passage 41 from the combustion chamber of the engine cylinder, not shown, with which this fuel injector is associated.

It will be apparent that in the subject fuel injector, as just described, it has only a back flow valve, in the form of check valve 50, ahead of the spray orifices, and that the variable area orifices formed by spray tip holes in the plunger valve 16 and the lower end of the nozzle valve body 15 serves the same function as a conventional needle valve, but with these important differences, as follows:

There is no throttling of fuel flow at the start and end of injection; there is no raw fuel remaining in a "sec" as there is none; the spray orifices are retracted into the nozzle valve body so that they are not exposed to the hot combustion gases in the cylinder with which the injector is associated; and, that all of the fuel injected during each fuel injection cycle is injected at essentially the same pressure, thus insuring proper atomization for all of the fuel injected during a cycle.

Figure 3:
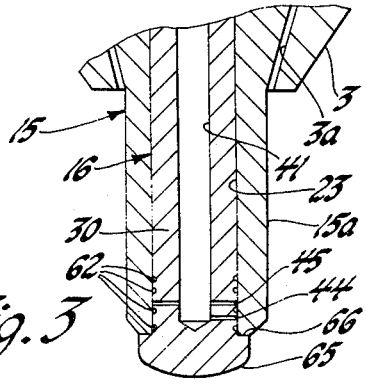

In the alternate embodiment of the fuel injector shown in FIG. 3, wherein like parts are identified by the use of the same reference characters as used in the description of the embodiment shown in FIGS. 1 and 2, the plunger valve 16 in this embodiment has the lower end of its lower stem portion 30 formed integral with an enlarged valve head 65 to provide an annular flange 66 extending radially outward adjacent to the outer periphery of the lower stem portion 30, which flange abuts against the free end face at the lower end 15*a* of the nozzle body thereby serving as a stop to limit retraction of the plunger valve into the nozzle body 15, in lieu of having the head 33 of the plunger valve abutting against the wall 36, as described with reference to the embodiment of the plunger valve shown in FIGS. 1 and 2. Of course, in this embodiment, the axial extend of the upper stepped stem portion 32 of the plunger valve would be less than that shown in the embodiment of this plunger valve illustrated in FIGS. 1 and 2 so that the valve head 65 would act as the retraction stop in the manner previously described, instead of having the head 33 abutting against the stop wall 36. In this alternate embodiment, the valve head 65 would then act as a secondary valve preventing cylinder gases from entering the injector and it would also serve to protect the orifice control end of the sleeve wall 23 from the hot gases of combustion within the cylinder, not shown, with which this fuel injector is associated.

Although the plunger valve 16, in both embodiments illustrated, is provided with at least one pilot spray orifice 44, it should be realized that, if desired, these pilot spray orifices need only be used in an application where pilot injection is desired, and need not be used in those engine applications where pilot injection is not required. However, if pilot spray orifices are used, the plunger valve rotational position and the direction of the pilot spray orifices 44 relative to the cylinder (not shown) would be targeted at the ignition source within the cylinder of a spark ignition-fuel injection type of engine.

Although the fuel injector of the invention is shown and described as being part of a unit fuel pump-injector, it should be realized that the subject fuel injector can be used as a separate injector, for example, as a fuel injector nozzle in a pump and nozzle system for use with various types of engines. It will be apparent that when it is used in such a system, the fuel injector would be physically separated from the fuel pump but connected thereto by suitable conduits for the flow of fuel between the injector and the pump and that the fuel injector itself will then be supported within a suitable injector housing having a fuel inlet providing a structure corresponding to the open end 11 of bushing 4 and an outlet corresponding to the structure providing the fuel chamber 5 of the unit fuel pump-injector illustrated and, that this injector housing would also be constructed in such a manner so as to provide a suitable seat for the check valve 50 of the subject fuel injector. It should also be realized that the fuel injector shown could also be used as an atomizing nozzle for oil burners, gas turbines, Stirling engines or any liquid flow where a constant degree of atomization was desired even though flow varied.

What is claimed is:

1. In a fuel injection device, an injector body means having a stepped bore extending from one end thereof to define in sequence at least an annular sleeve wall and an enlarged spring chamber means closed at one end opposite said sleeve wall, said injector body means having a valve controlled fuel passage means therein connectable at one end to a source of high pressure fuel and having its other end in fluid communication with the portion of said stepped bore providing said sleeve wall a predetermined axial distance from said one end of said injector body means, a plunger valve having a first stem means slidably fitting a portion of said stepped bore forming said sleeve wall and having a second stem means loosely extending into said spring chamber means, said plunger valve having an internal passage means in fluid communication at one end with said fuel passage means and having its other end terminating adjacent to the end of said first stem means opposite said second stem means, spray orifices extending through said first stem means adjacent said one end to said internal passage means and defining with said one end a discharge end of said first stem means, said plunger valve being movable in said stepped bore between a first position in which said discharge end is retracted within said sleeve wall to close off said spray orifices and a second position in which said discharge end is extended axially outward of said sleeve wall with said spray orifices then uncovered and, resilient means positioned within said spring chamber means to normally bias said plunger valve to said first position.

2. In a fuel injection device according to claim 1, wherein said plunger valve further includes a valve head at the end of said discharge end of said first stem means providing an annular shoulder extending radially outward of said first stem means externally of said injector body means to abut against said one end of said injector body means when said plunger valve is in said first position.

3. In a fuel injector device, a fuel pump including a plunger and a pumping chamber means for said plunger, an injector means including a plunger valve through which fuel delivered thereto from said pumping chamber is discharged under pressure developed by said pump, said plunger valve having fuel discharge orifices at one end thereof in communication with one end of an internal passage means within said pump plunger, an injector body means operatively connected to said fuel pump to receive fuel from said pumping chamber means, said injector body means having a stepped bore extending from one end thereof to define in sequence at least an annular sleeve wall extending from said one end and an enlarged spring chamber means closed at one end, said injector body means having a valve controlled fuel passage means therein connected at one end to the discharge end of said pumping chamber means and at its other end connected in fluid communication with said sleeve wall a predetermined axial distance from said one end of said injector body means, said plunger valve having a first stem means slidably fitting said sleeve wall and a second stem means extending into said spring chamber means, said first stem means having radial extending port means therein in communication at one end with said fuel passage means and at its other end with the opposite end of said internal passage means which is located within said first stem means, and plunger valve being movable in said stepped bore between a first position in which said spray orifices are retracted within said sleeve wall to be closed off thereby and a second position in which said spray orifices extend axially outward of said sleeve wall and, spring means in said spring chamber means operatively connected to said second stem means to normally bias said plunger valve to said first position.

4. In a fuel injection device according to claim 3 wherein said plunger valve further includes a valve head at the end of said first stem means opposite said second stem means providing an annular shoulder extending radially outward of said first stem means externally of said injector body means to abut against said one end of said injector body means when said plunger valve is in said first position.

5. In a fuel injector having an injector housing including a housing body means and a hollow nut forming an extension thereof, said housing body means having a planar end at one end thereof enclosed by said nut and having a fuel delivery chamber means extending from said planar end for delivery of high pressure fuel into said nut body, an injector body means supported within said nut body with one end of said injector body means in abutment against said planar wall and its opposite end extending outward through said nut, said one end of said injector body means also having an inlet chamber in fluid alignment with said fuel delivery chamber means, said injector body means having a stepped bore extending from its opposite end and terminating closely adjacent to said one end, said stepped bore including at least a first bore defining a first annular inner sleeve wall extending from said opposite end and a second bore of larger diameter than said first bore defining an inner peripheral wall terminating at a radial stop wall to provide a spring chamber, a passage means in said injector body means operatively connected at one end to said inlet chamber and having its other end intersecting said first bore adjacent to said second bore, a plunger valve having a first valve stem means at one end thereof slidably positioned within said first bore and a second stem means loosely extending into said spring chamber, said first valve stem means having a longitudinal extending fuel passage therein terminating closely adjacent to the free end of said first valve stem means, spray passage means adjacent to said free end of said first valve stem means intersecting said inner fuel passage and defining a spray tip end of said first valve stem means, radial fuel passages extending from the outer periphery of said first valve stem means to intersect said inner fuel passage, with said radial fuel passages being axially positioned on said first valve stem means for communication with said passage means, said plunger valve being movable in said stepped bore between a retracted position in which said spray tip is retracted within said first bore and an extended position at which said spray tip extends axially outward from said first bore, spring means in said spring chamber operatively connected to said plunger valve to normally bias said plunger valve to said retracted position and, a check valve operatively positioned in said inlet chamber to control flow between said fuel delivery chamber means and said inlet chamber.

6. A fuel injection device including a housing having a fuel inlet and a fuel outlet, bushing means in said housing providing a fuel pumping chamber and forming with said housing a fuel supply chamber in fluid communication with said fuel inlet and with said fuel outlet, said bushing having fuel port means therein connecting said fuel pumping chamber with said fuel supply chamber, a pump plunger reciprocally slidable in said bushing and controlling flow through said fuel port means, a nozzle body means seated in said housing opposite said plunger and having a chamber portion at one end thereof forming an extension of said fuel pumping chamber, said nozzle body means having a stepped bore extending from the opposite end thereof to define in sequence at least an annular sleeve wall and an enlarged spring chamber means closed at one end opposite said sleeve wall, said nozzle body means having a fuel passage means therein connected at one end to said chamber portion and having its other end in fluid communication with the portion of said stepped bore providing said sleeve wall a predetermined axial distance from said opposite end of said nozzle body means, a check valve positioned in said chamber portion and operable to prevent fluid flow from said chamber portion to said fuel pumping chamber, a plunger valve slidably positioned in said stepped bore, said plunger valve having a first stem means slidably fitting a portion of said stepped bore forming said sleeve wall and having a second stem means loosely extending into said spring chamber means, said plunger valve having an internal passage means in fluid communication at one end with said fuel passage means and having its other end terminating adjacent to the end of said first stem means opposite said second stem means, spray orifices extending through said first stem means to the opposite end of said internal passage means and defining with the said opposite end a discharge end of said first stem means, said plunger valve being movable in said stepped bore between a first position in which said discharge end is retracted within said sleeve wall to close off said spray orifices and a second position in which said discharge end is extended axially outward of said sleeve wall with said spray orifices then uncovered and, resilient means positioned within said spring chamber means to normally bias said plunger valve to said first position, said plunger valve being movable against said resilient means in response to fuel pressure from said pumping chamber to effect movement to said first position.

7. A fuel injection device according to claim 6 wherein said plunger valve further includes a valve head extending from said discharge end of said first stem means providing an annular shoulder extending radially outward of said first stem means positioned externally of said nozzle body means to abut against said one end of said nozzle body means when said plunger valve is in said first position.

* * * * *

UNITED STATES PATENT AND TRADEMARK OFFICE

CERTIFICATE OF CORRECTION

PATENT NO. : 3,982,693

DATED : September 28, 1976

INVENTOR(S) : Kenneth L. Hulsing

It is certified that error appears in the above-identified patent and that said Letters Patent are hereby corrected as shown below:

Column 2, line 50, "injector" (second occurrence) should read -- injection --.

Column 6, line 52, "extend" should read -- extent --.

Column 7, line 13, "injector" should read -- injection --.

Column 8, line 3, "injector" should read -- injection --.

Column 8, line 30, "and" should read -- said --.

Signed and Sealed this

First Day of February 1977

[SEAL]

*Attest:*

RUTH C. MASON
*Attesting Officer*

C. MARSHALL DANN
*Commissioner of Patents and Trademarks*